US011053055B2

(12) United States Patent
Koenigseder et al.

(10) Patent No.: US 11,053,055 B2
(45) Date of Patent: Jul. 6, 2021

(54) DISPENSING CLOSURE FOR A FLUID CONTAINER

(71) Applicant: Aptar Freyung GmbH, Freyung (DE)

(72) Inventors: Bruno Koenigseder, Roehrnbach (DE); Kristina Freund, Neukirchen vorm Wald (DE); Siegfried Runge, Passau (DE)

(73) Assignee: Aptar Freyung GmbH, Freyung (DE)

( * ) Notice: Subject to any disclaimer, the term of this patent is extended or adjusted under 35 U.S.C. 154(b) by 0 days.

(21) Appl. No.: 16/496,540

(22) PCT Filed: Mar. 23, 2017

(86) PCT No.: PCT/EP2017/057007
§ 371 (c)(1),
(2) Date: Sep. 23, 2019

(87) PCT Pub. No.: WO2018/171886
PCT Pub. Date: Sep. 27, 2018

(65) Prior Publication Data
US 2020/0377271 A1 Dec. 3, 2020

(51) Int. Cl.
*B65D 47/20* (2006.01)
*B65D 41/12* (2006.01)
(Continued)

(52) U.S. Cl.
CPC ..... *B65D 47/2025* (2013.01); *B65D 41/125* (2013.01); *B65D 41/3428* (2013.01);
(Continued)

(58) Field of Classification Search
CPC ..... B65D 2205/00; B65D 2401/20; B65D 2401/25; B65D 41/3428; B65D 41/125;
(Continued)

(56) References Cited

U.S. PATENT DOCUMENTS 2,806,620 A * 9/1957 Blanch ..... B65D 41/62 215/251
2,808,183 A * 10/1957 Olson ..... B65D 47/20 222/498

(Continued)

FOREIGN PATENT DOCUMENTS

CN 105197387 A 12/2015
DE 10 2009 000555 8/2010

(Continued)

OTHER PUBLICATIONS

International Search Report and Written Opinion of the International Searching Authority, dated Jan. 18, 2018 in International Application No. PCT/EP2017/057007.

(Continued)

*Primary Examiner* — Michael J. Melaragno
(74) *Attorney, Agent, or Firm* — Wood, Phillips, Katz, Clark & Mortimer

(57) ABSTRACT

The present invention relates to a dispensing closure for a fluid container with a spout for dispensing a fluid, said dispensing closure comprising a peripheral wall, a transverse wall and a toggle member, wherein said peripheral wall and said transverse wall are made of an elastic material. The dispensing closure also comprises a valve element.

8 Claims, 9 Drawing Sheets

(51) Int. Cl.
*B65D 41/34* (2006.01)
*B65D 47/32* (2006.01)
*B65D 51/16* (2006.01)

(52) U.S. Cl.
CPC ..... *B65D 47/32* (2013.01); *B65D 51/1644* (2013.01); *B65D 2205/00* (2013.01); *B65D 2401/20* (2020.05); *B65D 2401/25* (2020.05)

(58) Field of Classification Search
CPC . B65D 47/2025; B65D 47/32; B65D 51/1644
USPC ..... 222/511
See application file for complete search history.

(56) References Cited

U.S. PATENT DOCUMENTS 3,400,866 A * 9/1968 Fattori ..... B65D 47/2025 222/511
3,443,728 A * 5/1969 Scholle ..... B65D 47/2025 222/511
3,595,445 A * 7/1971 Buford ..... B65D 47/2025 222/213
3,655,105 A * 4/1972 Johns ..... B65D 47/046 222/484
3,739,938 A * 6/1973 Paz ..... A47G 19/2272 220/715
3,776,434 A * 12/1973 Christensen ..... B65D 47/061 222/525
3,786,964 A * 1/1974 Landen ..... B65D 47/305 222/153.14
3,853,250 A * 12/1974 Alpern ..... B65D 47/0866 222/517
3,863,818 A * 2/1975 Hazard ..... B65D 47/305 222/531
3,972,452 A * 8/1976 Welsh ..... B65D 47/2025 222/501
4,133,446 A * 1/1979 Albert ..... A47G 19/2272 220/254.5
4,135,649 A * 1/1979 Baldwin ..... B65D 47/2025 222/511
4,169,548 A * 10/1979 Bond ..... B65D 47/283 222/505
4,211,348 A * 7/1980 Scholle ..... B67D 3/042 222/498
4,248,362 A * 2/1981 Welsh ..... B65D 47/2025 222/505
4,444,340 A * 4/1984 Bond ..... B65D 47/2025 222/498
4,597,500 A * 7/1986 Stubbs ..... B65D 41/48 215/256
4,645,100 A * 2/1987 Wells ..... B65D 47/2025 222/505
4,666,064 A * 5/1987 Hoehn ..... B65D 47/2025 222/105
4,706,855 A * 11/1987 Litwin ..... B65D 47/2025 222/511
4,787,538 A 11/1988 Fattori
4,834,271 A * 5/1989 Litwin ..... B65D 47/2025 222/511
4,905,875 A * 3/1990 Straiton ..... B67D 3/042 141/354
5,000,359 A * 3/1991 Scholle ..... B65D 47/2025 215/232
5,074,441 A * 12/1991 Taguchi ..... B65D 47/2025 222/517
5,711,443 A * 1/1998 Bennett ..... B65D 41/62 215/256
6,003,742 A * 12/1999 Garcia ..... B65D 47/2025 222/508
6,050,436 A * 4/2000 Bennett ..... B65D 41/62 215/256
6,076,708 A * 6/2000 Ceccarelli ..... G01F 11/265 222/189.1
6,135,311 A * 10/2000 Panec ..... A47G 19/2266 220/705
8,616,416 B2 * 12/2013 Jordan ..... B65D 83/206 222/402.12
2003/0150191 A1 8/2003 Odet
2005/0077321 A1 * 4/2005 Liston ..... B65D 47/2025 222/185.1
2006/0266773 A1 * 11/2006 Lindmayer ..... B65D 47/2062 222/511
2007/0090110 A1 * 4/2007 Skelton ..... B65D 41/0478 220/254.9
2011/0220674 A1 * 9/2011 Honeyghan ..... B65D 47/0895 220/849
2011/0284541 A1 * 11/2011 Webster ..... B65D 50/045 220/288
2013/0175270 A1 * 7/2013 Fujita ..... B65D 47/2031 220/203.01
2013/0213923 A1 * 8/2013 Krautkramer ..... B65D 41/3428 215/252
2015/0265079 A1 9/2015 Kamping et al.
2015/0329253 A1 11/2015 Coloneri et al.
2015/0360820 A1 * 12/2015 Akutsu ..... B65D 1/02 222/566
2017/0066569 A1 3/2017 Wiesman

FOREIGN PATENT DOCUMENTS

WO 02/30782 4/2002
WO 2006/086835 8/2006

OTHER PUBLICATIONS

Chinese Office Action dated Dec. 2, 2020 for counterpart application No. 201780090853.0 in China.

* cited by examiner

DISPENSING CLOSURE FOR A FLUID CONTAINER

FIELD OF THE INVENTION

The present invention relates to a dispensing closure for a container with a spout or an opening for a dispensing fluid, especially for containers which are placed or stored upside down, such that the spout or opening of the container is, in use, at a lower side, or for containers which are lying essentially horizontally, with an opening or a spout at a side portion.

BACKGROUND OF THE INVENTION

Such containers are frequently used for storing milk, juice, water or wine or other fluid or viscous products as e.g. soap detergents, fabric softeners etc., but can be used also for other fluids or liquids.

Such a closure is for example known from WO 2006/086835.

BRIEF SUMMARY OF THE INVENTION

It is an object of the present invention to enhance such a closure as known in the prior art.

This problem is solved by a dispensing closure for a fluid container according to claim 1, claims 2 to 15 relate to specifically advantageous realization of such a dispensing closure. This problem is also solved by dispensing closure according to claim 16, while claims 17 and 18 relate to especially advantageous realizations of such a dispensing closure. Claim 19 refers to a system with a container and a dispensing closure.

According to the present invention, the dispensing closure comprises a peripheral wall, a transverse wall and a toggle member. The peripheral wall is adapted to at least partly fit within the spout and to seal against the spout of the container, when the closure is in its closed position and when the closure is attached to the container. The transverse wall extends inside of the peripheral wall, preferably for closing off the dispensing closure. The peripheral wall has preferably an essentially circular form, especially as the spouts and openings of containers, to which the dispensing closure shall be attached, also have a circular form. The toggle member extends from the transverse wall and is arranged to be manipulated by a user in order to bring the closure into its opened position and in order to enable a dispensing of a fluid or liquid stored into a container. The toggle member therefore extends from the transverse wall at a side being outside, in other words at a side being directed to the outside or to the atmosphere, not on a side which is directed to the inside of the container when the dispensing closure is attached to the container.

The peripheral wall and said transverse wall are made of an elastic material, preferably a flexible material which can be distorted when a force is exerted thereon and which then returns to its original form when the force is not exerted anymore. Preferred materials are for example thermoplastic elastomers or blends thereof, LD-PE, LLDPE etc.

According to the invention, the closure is arranged and adapted such that the closure is in its closed position when no force is exerted by user onto said toggle member and at least part of the transverse wall and at least part of the peripheral wall are distorted, when a force is exerted to said topic member by users, such that the seal between the peripheral wall and the spout of the container is partly opened to bring the closure in its opened position and to permit dispensing of fluid out of the container.

According to the invention, the dispensing closure further comprises a valve element. Said valve element is provided in said transverse wall and is arranged such that it is closed when said closure is in its closed position and such that it is at least partly open, when said closure is in its opened position, to permit flow of air into said container.

Such dispensing closures are especially useful in packages of the bag-in-box type, which comprise a flexible bag for reception of the fluid or viscous material, and a paperboard box or a box of another more rigid material for reception of a filled bag. When fluid is dispensed out of the container, in case of a bag-in-box type container, the flexible bag can shrink when the fluid is dispensed, while the dispensing of fluid is of course supported by gravity.

The dispensing of the liquid normally works well at the beginning, when the flexible bag in the bag-in-box type container is completely or still mainly filled, however, when the bag is more and more emptied, the bag will more and more collapse, which may lead to the effect that it is more difficult to dispense the liquid out of the bag, and there may be a remaining portion which cannot be dispensed at all.

The dispensing closure according to the present invention, however, provides a valve, which permits flow of air into said container, when said closure is in its opened position, so that these problems are remarkably reduced or even do not occur at all, and a better dispensing property can be provided, especially when the container is more empty, in order to also get the remaining fluid out of the container.

The dispensing closure according to the present invention, however, is also suitable for other containers, different from the bag-in-box type containers, especially for containers with rigid container walls, which, however may be used in a similar way as the bag-in-box containers, especially for containers which are placed upside down or which have the spout or opening at a downside part or at a side portion at a lower end and in which the spout or opening is placed such that, when the closure is opened, fluid is permitted to be dispensed under the influence of gravity without having to lift or move the container.

Without a dispensing closure as defined in the present invention, especially containing the valve element as defined, a dispensing of fluid of a container, e.g. with a solid wall, would not work properly or would even not be possible, and only by provision of the inventive valve element, air is permitted to flow into said container, filling the volume of the dispensed liquid, so that thereby a generation of a vacuum within the container, generated by a partial dispensing of fluid, is reduced or avoided, which would very soon remarkably deteriorate the dispensing property or even fully prevent a further dispensing of fluid.

The dispensing closure according to the present invention therefore not only remarkably enhances the dispensing properties of a dispensing closure of the prior art for bag-in-box type containers, but furthermore for the first time enable utilization of such closures in similar containers having a rigid container wall and therefore an essentially constant volume of the container, not being decreased by a dispensing of the fluid and a collapsing of the container by itself.

When the toggle is manipulated by a user to bring the closure from its closed position into its opened position, typically by pushing the toggle, the transverse wall and/or the peripheral wall, preferably both walls, are preferably distorted such that first a seal of the peripheral wall against the spout is at least partly opened to permit dispensing of the fluid out of the container. Only when further manipulating or pushing the toggle, the transverse wall and/or the peripheral wall are further distorted such that the valve is brought into its opened position to permit flow of air or atmosphere into said container.

This specific realization is especially advantageous as first the fluid is permitted to be dispensed out of the container, leading to an exact and desired dispensing and a certain decrease of pressure in a container, preferably with a rigid wall, by the exit of fluid out of the container, while thereafter the valve is at least partly opened, so that air can flow into said container and is preferably even sucked into the container by the decrease of pressure within the container, due to the exit of fluid out of the container.

Especially as air is permitted to flow into said container through the valve element, being separate from the opening through which fluid can be dispensed, an undisturbed dispensing and essentially laminar dispensing of fluid out of the container is achieved.

According to a preferred embodiment, said peripheral wall, said transverse wall and said toggle are made of the same material, while preferred materials are thermoplastic elastomers or blends thereof, LD-PE, LLDPE etc.

According to a further preferred realization said peripheral wall, said transverse wall and said toggle member are realized as a unitary element, which is preferably manufactured by injection molding. The injection molding could be a mono-injection molding or a hi-injection molding. Preferably the outer wall or the side wall is made out of hard resin, for example PP, HD-PE etc., and the parallel wall is made of a flexible resin, as referred to above.

In a preferred embodiment also the toggle is made of an elastic and preferably flexible material, but the toggle member is arranged such that it is more rigid than said peripheral wall and/or said transverse wall. This has the advantage that the toggle member gives a good haptic feeling to the user manipulating the toggle member, furthermore, by the more rigid realization of the toggle member, the desired deformation of the peripheral wall and/or the transverse wall can be exactly controlled and set. This enables a continuously exact controlling of the dispensing closure for the user.

According to a preferred embodiment of the dispensing closure, the peripheral wall comprises an external portion and an internal portion which together form a receiving space for accommodating the spout or parts of the spout of the fluid container when said dispensing closure is attached to said container.

This enables both an exact positioning of the dispensing closure on the spout of the container and also secures a tight and sealed connection to the container.

Further preferably said external portion of said peripheral wall comprises a dispensing opening, through which fluid can be dispensed, through the dispensing closure and out of the container.

Preferably said external portion of said peripheral wall comprises a sealing element adapted to seal against an outer part of the spout of the container, whereas this sealing element is adapted such that the seal is realized both when said dispensing closure is in its closed position and when said dispensing closure is in its opened position. Furthermore and further preferably said internal portion of said peripheral wall comprises a sealing element adapted to seal against an internal part of said spout of said container, wherein said sealing element is adapted such that it seals against the spout of the container when said dispensing closure is in its closed position and such that the seal is at least partly opened when said closure is in its opened position, wherein preferably the seal is opened in the vicinity of said dispensing opening of said external portion of the peripheral wall.

This specific realization has the advantage that one of the sealing elements, namely the sealing element at the external portion, is always in a sealing condition, especially in order to avoid any undesired dropping out of liquid, while only the sealing element adapted to seal against the internal part of said spout of said container is opened when said dispensing closure is moved into its opened position by manipulating the toggle by the user, so that a fluid can be dispensed through the opened sealing element at the internal part of said spout of said container and through said dispensing opening in said external portion of said peripheral wall.

According to a preferred realization of the dispensing closure according to the invention said valve element comprises at least one opening through said transverse wall, preferably multiple openings, e.g. 6 openings, and a closing element, which is adapted to close the opening or the multiple openings when said valve element is in its closed position and such that it opens the at least one opening or, if there are multiple openings at least one of the openings or multiple of the openings, at least partly, or even all of the openings, when said valve element is in its opened position, so that a flow of air from the outside into the container is permitted. Preferably said closing element is made of a rigid material, preferred materials are e.g. polypropylene or polyethylene, or also flexible materials, as e.g. TPE or silicone.

This specific realization of the valve has the advantage that it is first of all easy to manufacture, while secondly the fact that the openings, through which flow of air into said container is permitted, are realized directly within the flexible and elastic transverse wall. By providing a more rigid closing element, the relative movement of the closing element to the other parts of the valve element or the transverse wall is well defined and controlled, and the opening of the valve can be easily and reliably realized and secured by the manipulating of the toggle by a user, so that the dispensing closure can be reliably operated without the user having to initiate any additional steps or considering whether a valve has to be opened separately or not.

According to a preferred embodiment said closing element comprises a sealing surface and a post, preferably directly or indirectly extending from said sealing surface, said post being inserted into an opening of said transverse wall of said dispensing element and being attached to said transverse wall. This further secures an easy manufacturing process, as the peripheral wall, the transverse wall and the toggle member, including the openings of the valve element within the transverse wall, can be manufactured by a single step, e.g. by injection molding, while the rigid closing element can be manufactured separately, e.g. also by injection molding, and can easily be inserted into the opening of said transverse wall.

Preferably said valve element comprises a sealing wall extending from said transverse wall of said dispensing closure adapted to seal against the sealing surface of the closing element when said valve is in its closed position. Also such a sealing wall, extending into the direction of the interior of the container, secures a reliable functioning of the valve and a well controlled opening of the valve. Preferably said sealing wall is elastic and flexible and is made of the same material as the transverse wall, so that also this sealing wall can be manufactured together with the peripheral wall, the transverse wall and the toggle member in a single manufacturing step, as mentioned above preferably by injection molding.

In a further preferred embodiment, said transverse wall comprises an actuating element, preferably extending from an upper or outer side of the transverse wall, i.e. on a side of the wall opposite to where the sealing wall does extend, while said actuating element is arranged such that it exerts a force onto said valve element, preferably on said post of said closing element, when said toggle is manipulated by the user in order to distort said transverse wall and to bring the dispensing closure into its opened position. This in addition secures a correct and controlled functioning and especially opening of the valve element when said dispensing closure is brought into its opened position by manipulation of the toggle by a user.

The present invention also relates to a dispensing closure for a container, with a spout for a dispensing fluid, especially as described above, said dispensing closure comprising a peripheral wall, a transverse wall and a toggle member, especially as described above, wherein said peripheral wall and said transverse wall are made of an elastic material. According to another, even independently inventive aspect, said closure further comprises a fastening element being made of a rigid material, said fastening element being attached to said peripheral wall, preferably to a lower part of said peripheral wall, for securing the dispensing closure to the spout of the container, wherein the dispensing closure further comprises a cap being attached to said fastening element by a removable temper evident element, preferably being realized as a removable temper evident ring.

Such a dispensing closure has the advantage that the material for the peripheral wall and the transverse wall can be selected solely with respect to its functioning, especially realizing the desired elastic and/or flexible properties in order to secure a well functioning of the closure and the desired distortion of the peripheral wall and the transverse wall, necessary for a proper opening of the dispensing closure in order to allow a dispense of liquid from the container, while at the same time securing a reliable fastening of the dispensing closure to the container, which may not be possible without said rigid fastening element, depending on the material selected for especially the peripheral and/or transverse wall.

According to this further inventive aspect, the dispensing closure comprises a cap, which protects the dispensing closure from dust and dirt, especially the peripheral wall and the transverse wall as well as the toggle member, while additionally the peripheral wall and the transverse walls are also protected, so that any undesired damages are avoided, e.g. during transport etc., especially before the cap is opened for the first time.

Furthermore, the temper evident element secures, together with the fastening element of a rigid material, an unnoticed opening of the dispensing closure and therefore secures integrity of the container and the fluid stored in the container.

Of course, even after a first opening of the cap and the removal of the temper evident element, preferably a temper element ring, the cap can still be placed onto the dispensing closure for continued protection of the dispensing closure, while nevertheless it would be easily visible from the outside that the dispensing closure has already been opened at least once.

Preferably said fastening element, said temper evident element and said cap are made of the same rigid material, preferably polypropylene, HD-PE, polyethylene or other flexible resins like thermoplastic elastomers or silicone and, even more preferably, these three elements are also realized as a unitary element, which can be manufactured in one step, e.g. by injections molding.

Of course such a dispensing closure with a fastening element, a cap and a removable temper evident element is especially suitable for a dispensing closure as described earlier in the description and as defined in claims 1 to 15, however, it can in principle be also used with other dispensing closures and realized an independent inventive aspect.

The invention also covers a system with a container and such dispensing closures.

BRIEF DESCRIPTION OF THE DRAWINGS

Further advantages of a dispensing closure and of a system according to the present invention will become even more apparent in view of the preferred embodiment shown in the following figures.

DETAILED DESCRIPTION OF THE PREFERRED EMBODIMENTS

Figure 1:
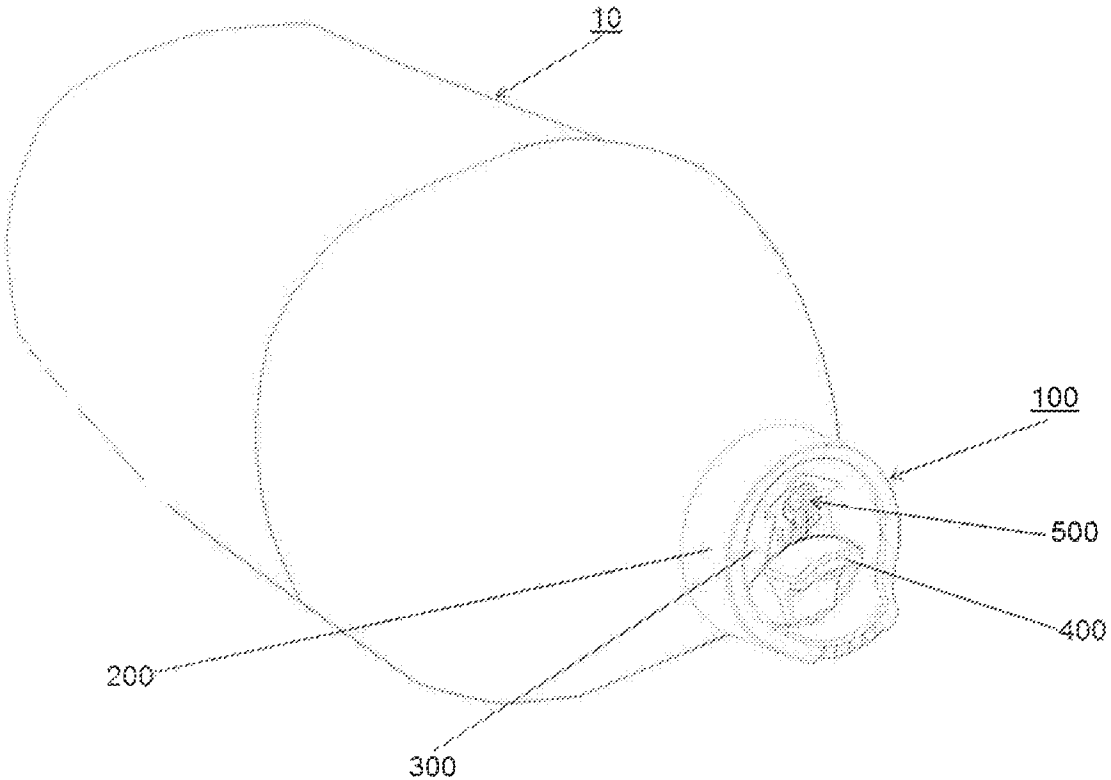
FIG. 1 shows an embodiment of an inventive dispensing closure being attached to a container.

FIG. 1 shows an embodiment of a dispensing closure 100 being mounted on a container 10. The dispensing closure 100 comprises a peripheral wall 200, a transverse wall 300, a toggle member 400 and a valve element 500, details of which will become more apparent in the following figures.

The container 10 is shown as lying essentially in a horizontal direction, in which the container is also used, so that by manipulating the toggle member 400 by a user, thereby bringing the dispensing closure 100 into its opened position, fluid will be dispensed through a dispensing opening (see FIG. 2) due to the gravity influencing the fluid in the container 10.

Figure 2:
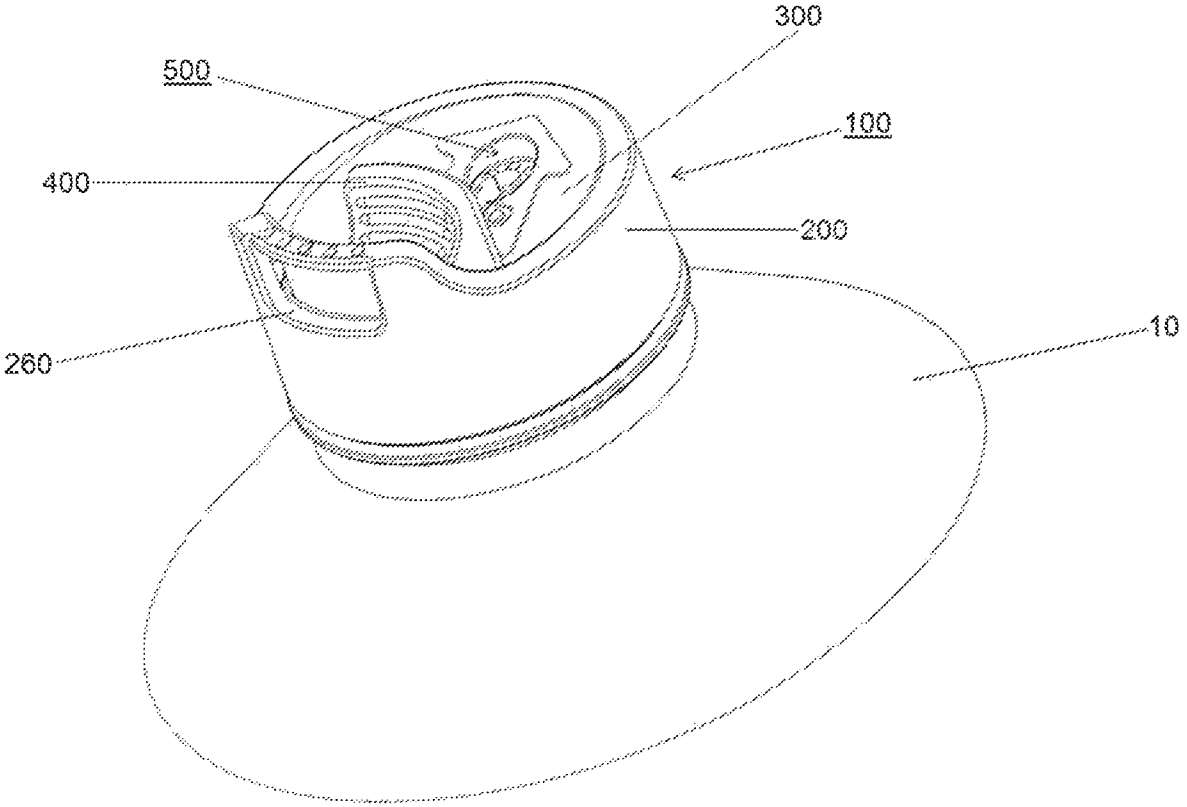
FIG. 2 shows another perspective view of the dispensing closure in some more detail with parts of the container omitted.

FIG. 2 shows an enlarged view of the dispensing closure 100 as shown in FIG. 1 from a different perspective, while parts of the container 10 have been omitted. FIG. 2 also shows the peripheral wall 200, the transverse wall 300, the toggle member 400 and the valve element 500 as well as a dispensing opening 260 being formed into the peripheral wall 200, through which liquid can be dispensed out of the container when the dispensing closure 100 is in its opened position.

Figure 3:
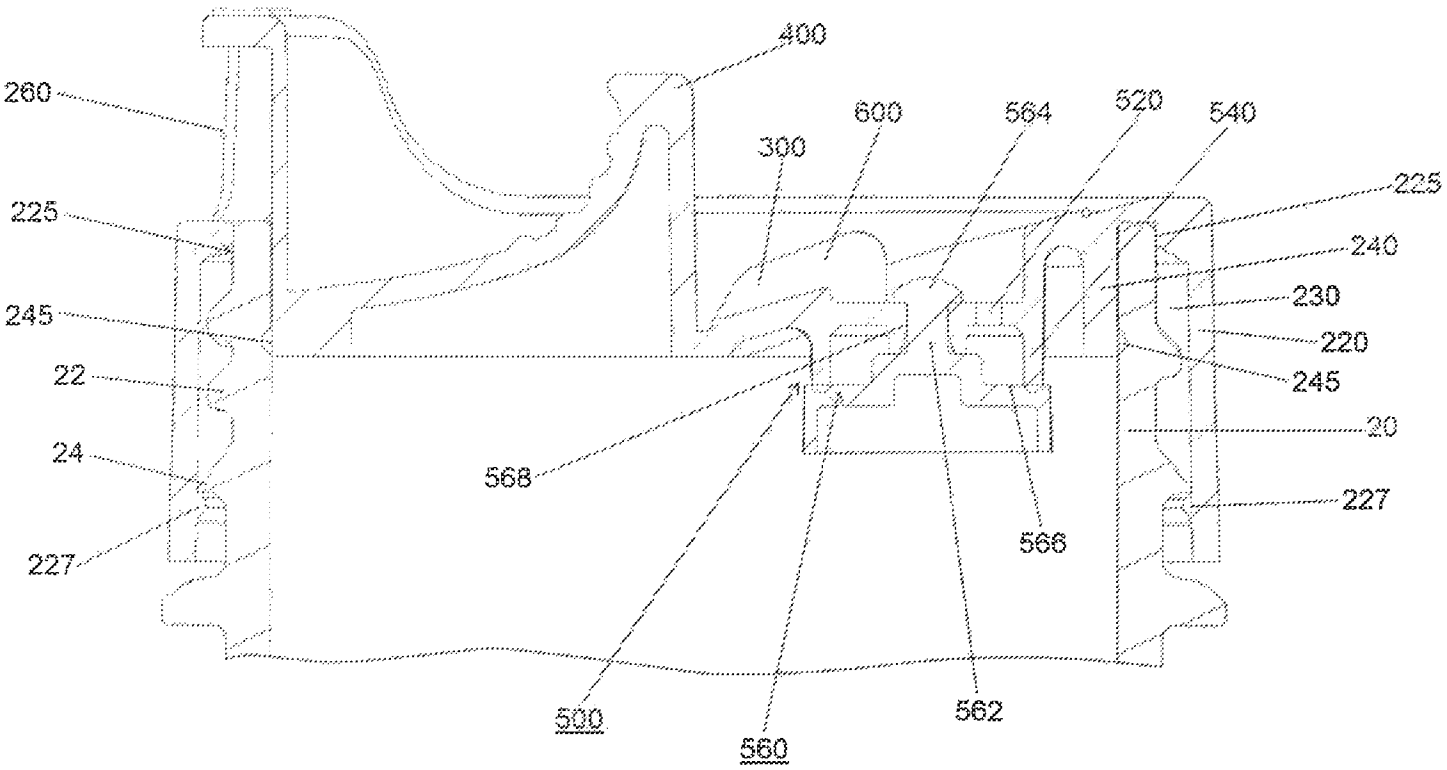
FIG. 3 shows a cross section through the dispensing closure and part of a spout of the container, with the dispensing closure being in its closed position.

FIG. 3 shows a cross section through the dispensing closure 100 as shown in FIGS. 1 and 2 with parts of the container 10, more exactly with parts of the spout 20 of the container 10.

As can be well seen in FIG. 3, the dispensing closure 100 comprises a peripheral wall with an external portion 220 or an external wall and an internal portion 240 or internal wall, which together form a receiving space 230 in between for accommodating the spout 20 or parts of the spout 20 of the container, when said dispensing closure is attached to said container as shown in FIG. 3.

As can be also well seen in FIG. 3, the spout 20 of the container comprises an outer thread 22, which, however, is not used in this specific embodiment, as the dispensing closure 100 is not screwed onto the spout but pushed onto the spout 20.

As can be also well seen in FIG. 3, the spout 20 comprises an outer notch 24, whereas the external portion 220 of the peripheral wall 200 comprises an inner notch 227, whereas these notches 24 and 227 do engage with each other when the dispensing closure 100 is pushed onto the spout 20, so that the dispensing closure 100 is attached to and fixed to the spout 20 and thereby to the container.

The notch 227 can also serve as an additional sealing element.

Furthermore, the outer portion 220 of the peripheral wall 200 comprises a sealing element 225, sealing against an upper part of the spout 20, so that no liquid can enter into the receiving space 230 or leak out of the closure.

Also the inner portion 240 of the peripheral wall 200 comprises a sealing element 245, which seals against an inner portion or inner side wall of the spout 20.

This sealing element 245 is essentially ring-like and seals against the inner part or inner side wall of the spout 20 over its complete circumference, when said dispensing closure 100 is in its closed position as shown in FIG. 3. No liquid can therefore be dispensed in this closed position of the dispensing closure 100.

The dispensing closure 100 also comprises a valve element 500, which comprises multiple openings 520 in the transverse wall 300 and which comprises a closing element 560 with a post 562 and a sealing surface 566. As can be well seen in FIG. 3, the post 562 is inserted through an opening 568 in the transverse wall 300, while a head portion 564, having a larger diameter than the rest of the post 562, secures the closing element 560 to the transverse wall 300.

The valve element 500 also comprises a sealing wall 540, which has an essentially cylindrical form, extending from said transverse wall 300 of said dispensing closure 100. The sealing wall 540 is, over its complete circumference, in contact with the sealing surface 566 of the closing element 560, so that the valve element 500 is, in the position shown in FIG. 3, closed and sealed, so that also no air can enter from the outside into the container.

Figure 4:
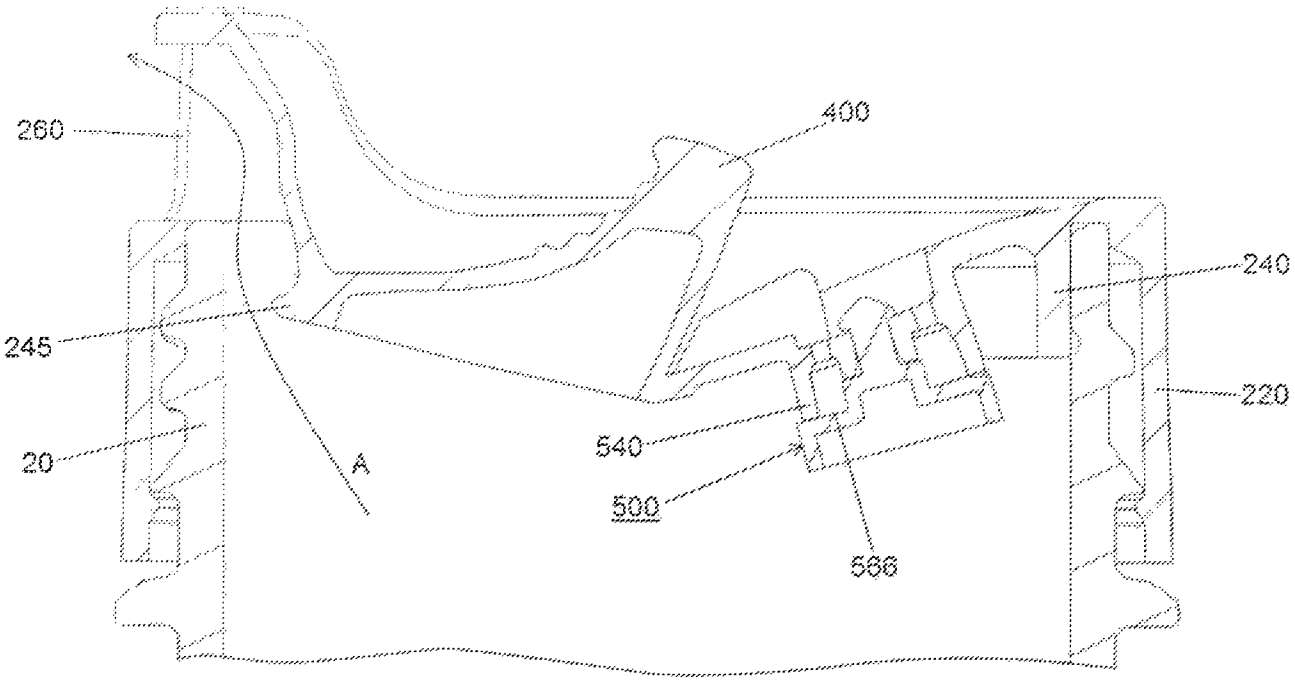
FIG. 4 shows the same view as FIG. 3, however, with the dispensing closure being moved out of its closed position into the direction of its opened position.

FIG. 4 shows the dispensing closure 100 as shown in FIG. 3, however in a position in which a user manipulates the toggle member 400, pushing the toggle member 400 partly into the direction of the container or spout, in FIG. 4 downwards, in order to move the dispensing closure into its opened position.

As can be well seen, both the transverse wall 300 as well as parts of the peripheral wall 200 are distorted, such that the sealing member 245 moves away from the inner part or inner side wall of the spout 20, so that liquid can be dispensed as indicated by the arrow A.

As can be also well seen in FIG. 4, the transverse wall is partly distorted, however, the valve element 500 is still in its closed position, with the sealing wall 540 still being in contact with the sealing surface 566 of the closing element 560, so that still no air can enter into the container via the valve element 500.

Figure 5:
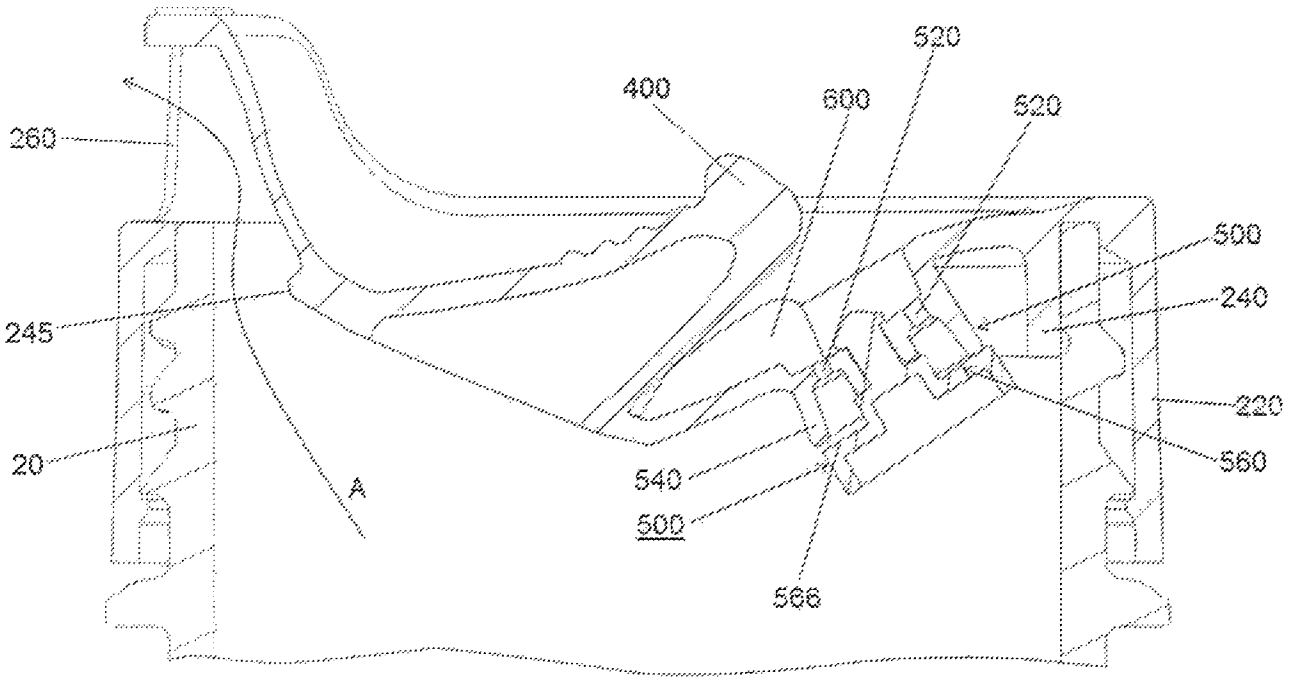
FIG. 5 shows the same view as FIG. 3, however, with the dispensing closure in its opened position.

FIG. 5 shows the dispensing closure as shown in FIG. 3 and FIG. 4, however, with the dispensing closure in its fully opened position, by the manipulation of the user.

As can be well seen in FIG. 5, liquid can be dispensed out of the container as indicated by arrow A through the dispensing opening 260, while, in comparison to the position in FIG. 4, more liquid can be dispensed as the sealing element 245 is moved further away from the inner wall of the spout 20.

Furthermore, due to the further distortion of the transverse wall 300, also controlled and supported by the actuating element 600, the valve element 500 is in its opened position, with the sealing wall 540 at least partly not being in contact anymore with the sealing surface 566 of the closing element 560, so that air can enter into the container through the openings 520 and between the sealing wall 540 and the sealing surface 566.

Thereby the volume of the container (not shown) which is not occupied anymore by the liquid as being dispensed, can be filled with air from the atmosphere, so that continuously a dispensing of fluid can be performed in a controlled way, especially a constant and preferably laminar dispensing can be secured.

Figure 6:
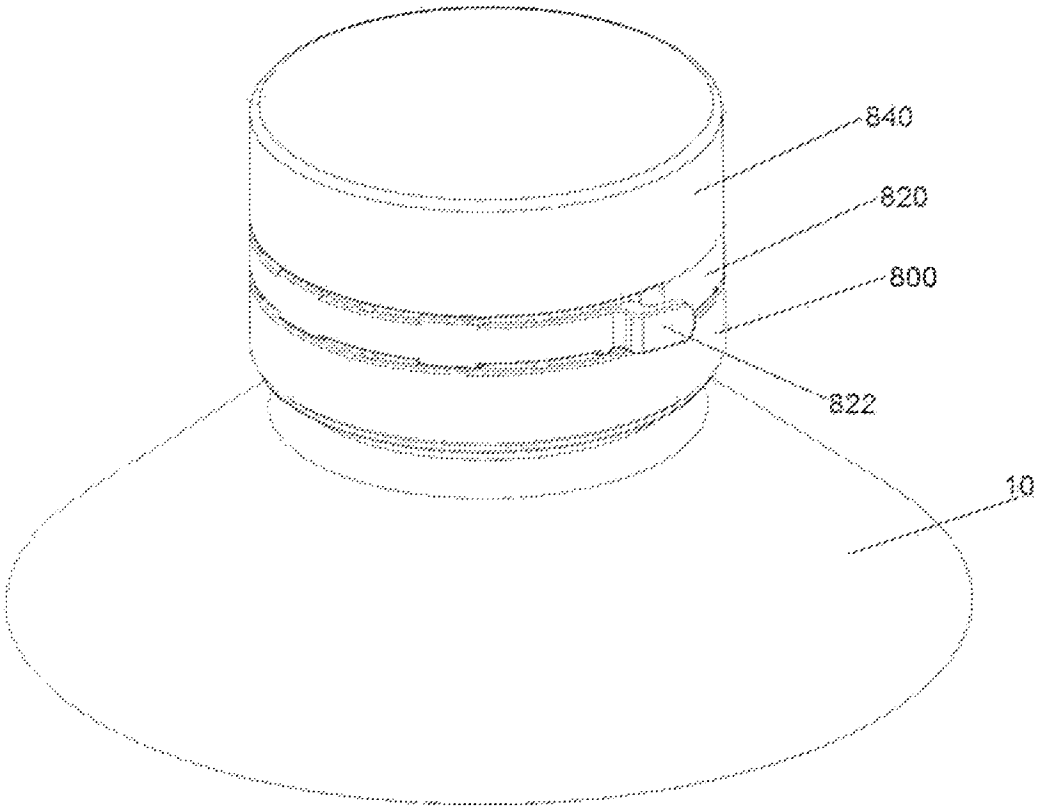
FIG. 6 shows another embodiment of a dispensing closure according to the present invention with parts of a container to which it is attached.

FIG. 6 shows another embodiment of a dispensing closure according to the present invention, which is very similar to the embodiment shown in FIGS. 1 to 5, so that it is referred to the above-mentioned description, in order to avoid repetitions, while the same or similar elements are also indicated with the same reference numerals.

FIG. 6 shows a dispensing closure with a fastening element 800, being made of a rigid material, here polypropylene or polyethylene, being attached to a lower part of the peripheral wall of the dispensing closure for securing the dispensing closure to the spout of the container. Furthermore, the dispensing closure comprises a cap 840 being attached to said fastening element 800 by a removable temper evident element 820, which is essentially ring-like in this embodiment. The temper evident element 820 has a grip portion 822, which can be grabbed by a user to remove the removable temper evident element 820, thereby enabling a removement of the cap 800, as will be shown in FIG. 7.

Figure 7:
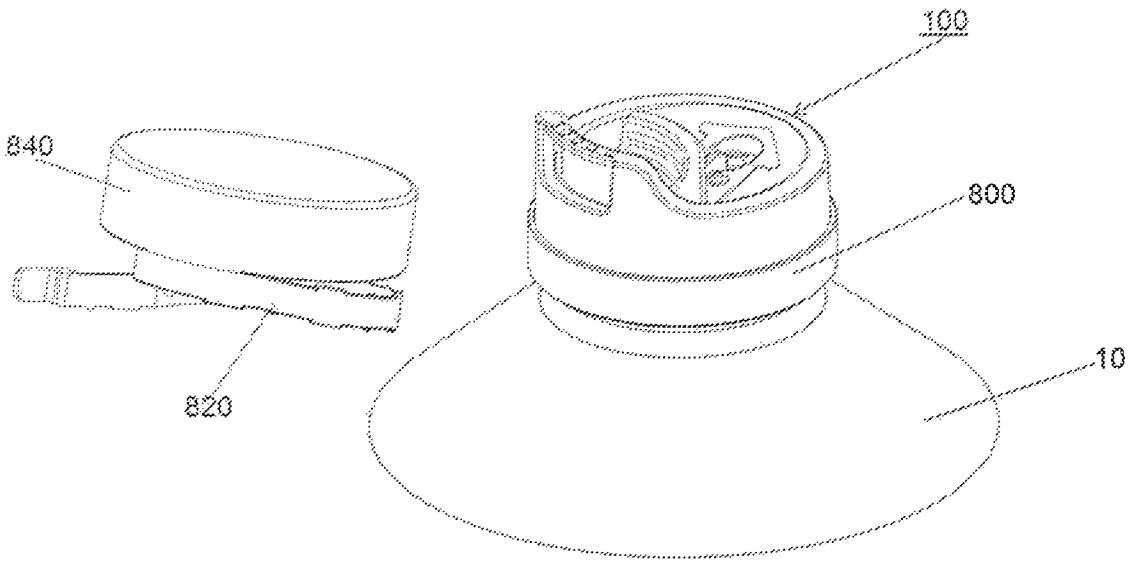
FIG. 7 shows the embodiment of the dispensing closure as shown in FIG. 6, with a cap and a temper evident element being removed.

FIG. 7 shows the embodiment of the dispensing closure as shown in FIG. 6, however with the temper evident element 820 being opened and the cap 840 being removed.

As can be well seen in FIG. 7, the temper element 820 is completely detached from the fastening element 800 and, as shown in FIG. 7, still partly attached to the cap 840. The fastening element 800 remains in its original position, its functioning will be better explained in connection with the description of FIG. 8, see hereinafter.

It has to be noted that in this specific embodiment the temper evident element 820 and the cap 840 are adapted such that the temper evident element 820 remains partly fixed to the cap 840, however, in other embodiments, it is also possible to completely remove the temper evident element 820 also from the cap 840.

Figure 8:
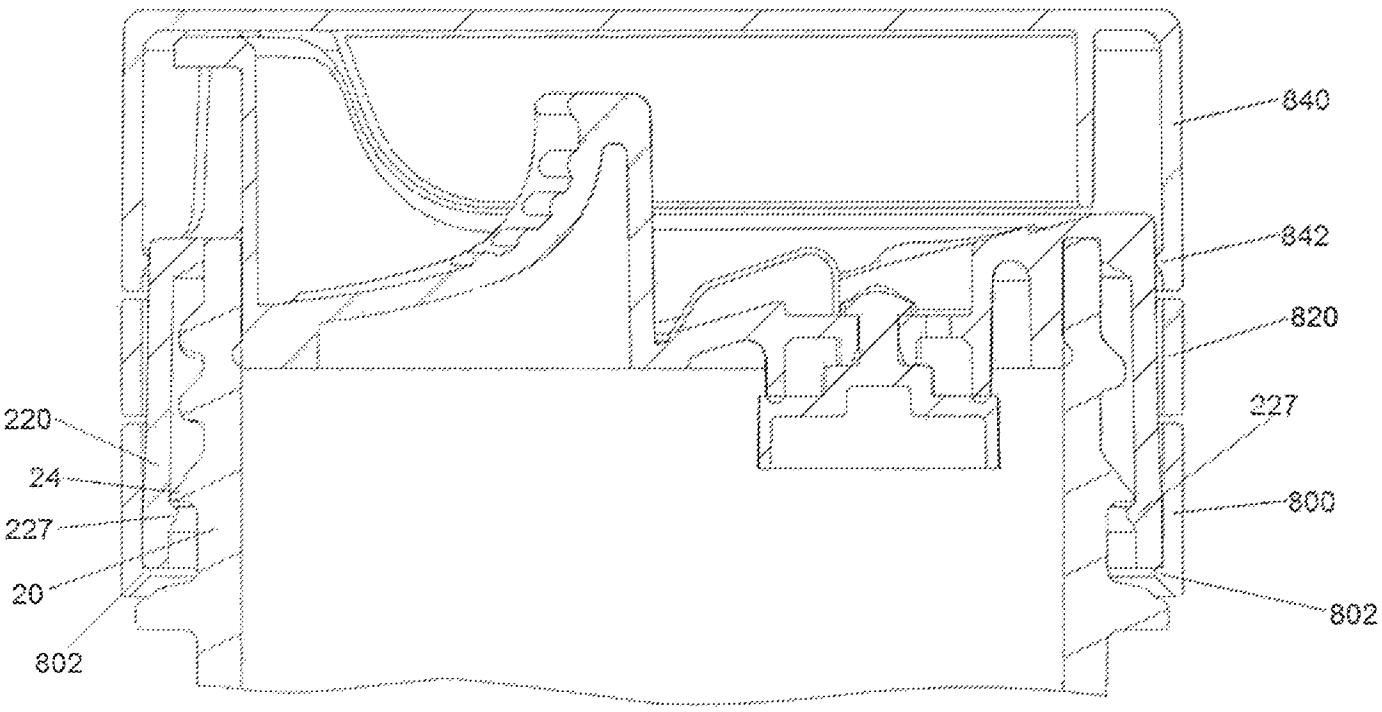
FIG. 8 shows a cross section of the embodiment of the dispensing closure as shown in FIG. 6.

FIG. 8 shows the embodiment of the dispensing closure as shown in FIGS. 6 and 7, with the cap 840 and the temper evident element 820 still being attached to the fastening element 800, as shown in FIG. 6.

As can be well seen, the fastening element 800, being made of a rigid material, secures the external portion 220 of the peripheral wall in its position, so that especially the notches 24 and 227 are still engaged with each other.

Furthermore, the fastening element 800 comprises a notch 820, being an engagement with a lower part of the external portion 220 of the peripheral wall 200, securing the position of the fastening element 800 relative to the external portion 220 of the peripheral wall 200.

This is of specific importance for closures with a peripheral wall being made of an elastic and/or flexible material, as it is the case in this embodiment, as this material is important for the functioning of the dispensing closure, however, the flexibility of the material also bares a risk that the dispensing closure can be more easily removed from the spout 20 of the container.

The fastening element 800, however, is made of a more rigid material and therefore increases the force being necessary to detach the dispensing closure 100 from the neck 20 of the container. Preferably the fastening ring 800 is arranged such that the fastening ring 800 and the dispensing closure 100 cannot be removed from the neck 20 of the container without destroying or partly destroying the fastening ring 800.

As can be also well seen in FIG. 8, the fastening ring 800, the temper evident element 820 and the cap 840 cover the dispensing closure 100 essentially completely to the outside, so that the dispensing closure 100 is protected from dust or dirt and also protected from any damages during transport etc.

As can be also well seen in FIG. 8, the cap 840 comprises an inner, ring-like seal portion 842, which seals the cap 840 to the dispensing closure 100, in this embodiment to the external portion 220 of the peripheral wall 200. This ring-like sealing portion 842 also leads to a certain friction between the cap 840 and the external portion 220 of the peripheral wall 200, which leads to the effect that the cap 840 can be, after first removal, also be placed again onto the dispensing closure for covering and protection, such that a certain force is necessary to remove the cap 840 again, also avoiding that the cap 840 just falls off unintentionally from the dispensing closure 100.

Figure 9:
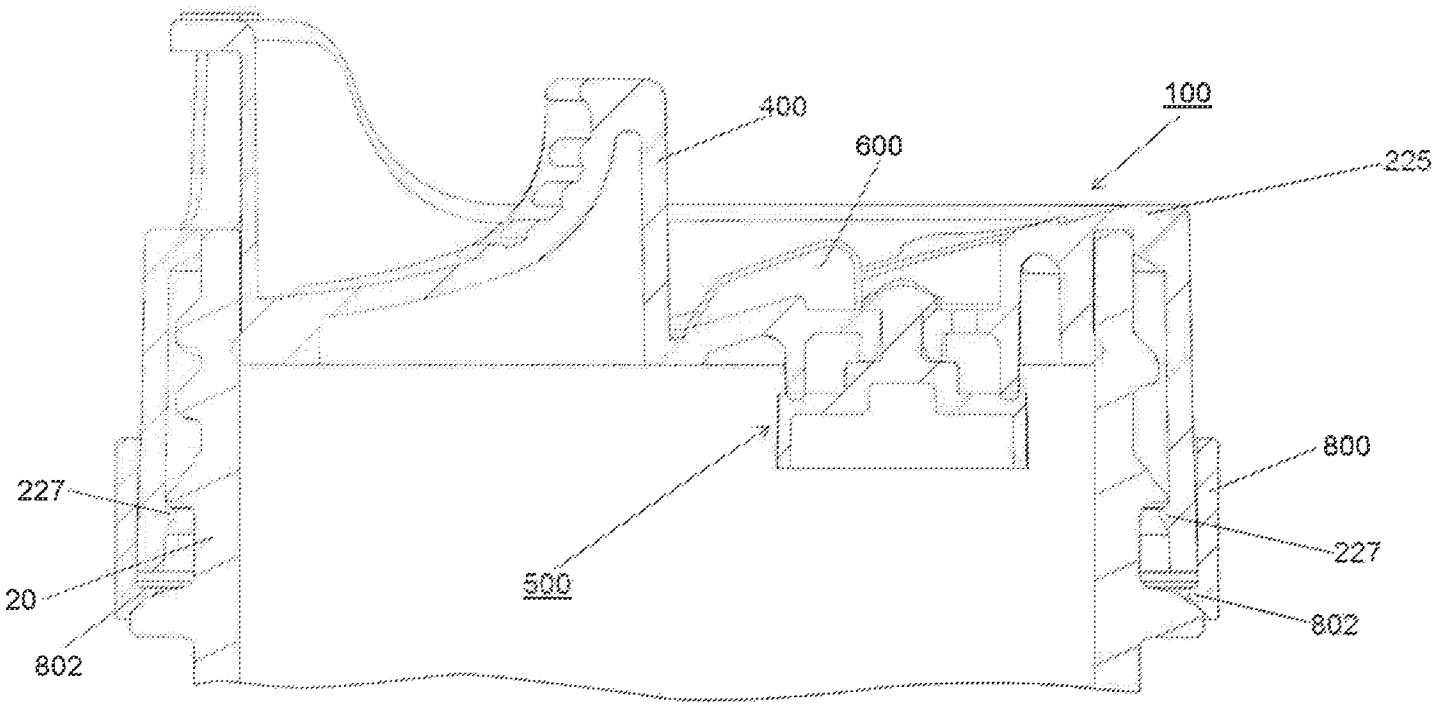
FIG. 9 shows a cross section of the embodiment of a dispensing closure as shown in FIG. 7, with the cap and the temper evident element being removed.

FIG. 9 shows a cross section of the dispensing closure as shown in FIGS. 6 to 8, with the cap and the temper evident element being removed as shown in FIG. 7.

As can be well seen in FIG. 9, the fastening element 800 remains in its position and secures an exact positioning and attachment of the dispensing closure 100 on the spout 20 of the container, even if, as in this embodiment, the dispensing closure and especially the peripheral wall and the external portion 220 of the peripheral wall are made of a flexible, elastic material.

With respect to the functioning of the dispensing closure 100, it is especially referred to FIGS. 3 to 5 and the description thereof, as the embodiment of the dispensing closure shown in FIGS. 6 to 9 is identical in this respect.

In order to avoid repetition, it is otherwise referred to the description of the earlier described embodiment.

The features of the present invention disclosed in the specification, the claims and/or in the accompanying drawings may, both separately and in any combination thereof, be material for realizing the invention in various forms thereof.

The invention claimed is:

1. A dispensing closure (100) for a container (10) with a spout (20) for dispensing a fluid, said dispensing closure comprising:

a peripheral wall (200) adapted to at least partly fit within the spout and to seal against the spout, when the closure (100) is in its closed position, a transverse wall (300) extending inside of the peripheral wall (200), and a toggle member (400) extending from the transverse wall (300) to be manipulated by a user, wherein said peripheral wall (200) and said transverse wall (300) are made of an elastic material, and wherein said closure (100) is arranged and adapted such that a) the closure (100) is in its closed position when no force is exerted by a user onto said toggle member (400), and b) at least part of the transverse wall (300) and at least part of the peripheral wall (200) are distorted when a force is exerted onto said toggle member (400) by a user such that the seal between the peripheral wall (200) and the spout of the container (10) is at least partly opened to bring the closure (100) in its opened position and to permit dispensing of the fluid out of the container (10), wherein said dispensing closure (100) further comprises a valve element (500), said valve element (500) being provided in said transverse wall (300) and being arranged such that it is closed when said closure (100) is in its closed position and such that it is at least partly open when said closure (100) is in its opened position to permit flow of air into said container (100), wherein an external portion (220) of said peripheral wall (200) comprises a dispensing opening (260), and said dispensing opening (260) is configured to permit dispensing of the fluid out of the container (10) when said toggle member (400) is moved away from said dispensing opening (260).

2. The dispensing closure according to claim 1, wherein said internal portion (240) of said peripheral wall (200) comprises a sealing element (245) adapted to seal against an internal part of said spout (20) of said container (10), wherein said sealing element (245) is adapted such that it seals against the spout (20) of the container (10) when said dispensing closure (100) is in its closed position and such that the seal is at least partly opened when said closure is in its opened position, wherein the seal is opened in the vicinity of said dispensing opening (260) of said external portion (220) of the peripheral wall (200).

3. A dispensing closure (100) for a container (10) with a spout (20) for dispensing a fluid, said dispensing closure comprising:

a peripheral wall (200) adapted to at least partly fit within the spout and to seal against the spout, when the closure (100) is in its closed position, a transverse wall (300) extending inside of the peripheral wall (200), and a toggle member (400) extending from the transverse wall (300) to be manipulated by a user, wherein said peripheral wall (200) and said transverse wall (300) are made of an elastic material, and wherein said closure (100) is arranged and adapted such that a) the closure (100) is in its closed position when no force is exerted by a user onto said toggle member (400), and b) at least part of the transverse wall (300) and at least part of the peripheral wall (200) are distorted when a force is exerted onto said toggle member (400) by a user such that the seal between the peripheral wall (200) and the spout of the container (10) is at least partly opened to bring the closure (100) in its opened position and to permit dispensing of the fluid out of the container (10), wherein said dispensing closure (100) further comprises a valve element (500), said valve element (500) being provided in said transverse wall (300) and being arranged such that it is closed when said closure (100) is in its closed position and such that it is at least partly open when said closure (100) is in its opened position to permit flow of air into said container (100), wherein said valve element (500) comprises at least one opening (520) through said transverse wall (300) and a closing element (560), said closing element (560) being adapted to close the opening (520) when said valve element (500) is in its closed position and being adapted to open at least one opening at least partly when said valve element (500) is in its opened position to permit flow of air into said container, and wherein said closing element (560) is made of a rigid material.

4. The dispensing closure according to claim 3 wherein said closing element (560) comprises a sealing surface (566) and a post (562), said post (502) extending from said sealing surface (566), said post (562) being inserted into an opening (568) of said transverse wall (300) of said dispensing closure and being attached to said transverse wall (300).

5. A dispensing closure (100) for a container (10) with a spout (20) for dispensing a fluid, said dispensing closure comprising:

a peripheral wall (200) adapted to at least partly fit within the spout and to seal against the spout, when the closure (100) is in its closed position, a transverse wall (300) extending inside of the peripheral wall (200), and a toggle member (400) extending from the transverse wall (300) to be manipulated by a user, wherein said peripheral wall (200) and said transverse wall (300) are made of an elastic material, and wherein said closure (100) is arranged and adapted such that a) the closure (100) is in its closed position when no force is exerted by a user onto said toggle member (400), and b) at least part of the transverse wall (300) and at least part of the peripheral wall (200) are distorted when a force is exerted onto said toggle member (400) by a user such that the seal between the peripheral wall (200) and the spout of the container (10) is at least partly opened to bring the closure (100) in its opened position and to permit dispensing of the fluid out of the container (10), wherein said dispensing closure (100) further comprises a valve element (500), said valve element (500) being provided in said transverse wall (300) and being arranged such that it is closed when said closure (100) is in its closed position and such that it is at least partly open when said closure (100) is in its opened position to permit flow of air into said container (100), wherein said valve element (500) comprises at least one opening (520) through said transverse wall (300) and a closing element (560), said closing element (560) being adapted to close the opening (520) when said valve element (500) is in its closed position and being adapted to open at least one opening at least partly when said valve element (500) is in its opened position to permit flow of air into said container, and wherein said valve element (500) comprises a sealing wall (540) extending from said transverse wall (300) of said dispensing closure (100) adapted to seal against a sealing surface (566) of the closing element (560) when said valve (500) is in its closed position.

6. Dispensing closure according to claim 5, wherein said sealing wall (540) is flexible and is made of the same material as the transverse wall (300).

7. A dispensing closure (100) for a container (10) with a spout (20) for dispensing a fluid, said dispensing closure comprising:

a peripheral wall (200) adapted to at least partly fit within the spout and to seal against the spout, when the closure (100) is in its closed position, a transverse wall (300) extending inside of the peripheral wall (200), and a toggle member (400) extending from the transverse wall (300) to be manipulated by a user, wherein said peripheral wall (200) and said transverse wall (300) are made of an elastic material, and wherein said closure (100) is arranged and adapted such that a) the closure (100) is in its closed position when no force is exerted by a user onto said toggle member (400), and b) at least part of the transverse wall (300) and at least part of the peripheral wall (200) are distorted when a force is exerted onto said toggle member (400) by a user such that the seal between the peripheral wall (200) and the spout of the container (10) is at least partly opened to bring the closure (100) in its opened position and to permit dispensing of the fluid out of the container (10), wherein said dispensing closure (100) further comprises a valve element (500), said valve element (500) being provided in said transverse wall (300) and being arranged such that it is closed when said closure (100) is in its closed position and such that it is at least partly open when said closure (100) is in its opened position to permit flow of air into said container (100), wherein said transverse wall (300) comprises an actuating element (600), extending from an upper or outer side of said transverse wall (300) and being arranged such that it exerts a force onto said valve element (500), when said toggle (400) is manipulated by the user to bring the dispensing closure into its opened position.

8. The dispensing closure according to claim 7, wherein said valve element (500) comprises at least one opening (520) through said transverse wall (300) and a closing element (560), said closing element (560) comprises a sealing surface (566) and a post (562), wherein said actuating element (600) is arranged such that it exerts a pressure onto said post (562) of said closing element (560) when said toggle (400) is manipulated by the user to bring the dispensing closure into its opened position.

* * * * *